US005520128A

United States Patent [19]

Rich et al.

[11] Patent Number: 5,520,128

[45] Date of Patent: May 28, 1996

[54] TOY EMBROIDERY MACHINE HAVING ROTATABLE MEANS FOR ACTIVATING A SELECTIVELY ENERGIZABLE DRIVE MECHANISM

[76] Inventors: Hugh Rich, 7682 Colgate, Westminster, Calif. 92683; Judy Shackelford, 710 24th St., Santa Monica, Calif. 90402

[21] Appl. No.: 330,430

[22] Filed: Oct. 27, 1994

[51] Int. Cl.[6] ..... D05B 69/36

[52] U.S. Cl. ..... 112/277; 112/169; 112/261

[58] Field of Search ..... 112/78, 98, 261, 112/80.16, 266.2, 277, 258, 259, 260, 169

[56] References Cited

U.S. PATENT DOCUMENTS

| | | | |
|---|---|---|---|
| 4,150,634 | 4/1979 | Brown et al. | 112/261 X |
| 4,274,349 | 6/1981 | Doyel | 112/169 |
| 4,319,532 | 3/1982 | Fogarty et al. | 112/169 |
| 4,711,190 | 12/1987 | Smith . | |
| 4,854,250 | 8/1989 | Stiivecke et al. . | |

FOREIGN PATENT DOCUMENTS

| | | |
|---|---|---|
| 344063 | 8/1934 | Canada . |
| 1010077 | 5/1977 | Canada . |

*Primary Examiner*—Peter Nerbun
*Attorney, Agent, or Firm*—Dick and Harris

[57] ABSTRACT

A toy embroidery apparatus has a needle mounted movement reciprocally within the housing. An arm is pivotally mounted on the housing for movement between an operational position and a standby position. When the arm is in the operational position, a tubular shroud encloses a tip of the needle as it reciprocates and prevents the arm from pivoting until the tip of the needle is fully retracted within the housing. A drive effects reciprocating movement of a tip of the needle in and out of the housing. A switch selectively energizes the drive. The switch is rotatable between a locked condition wherein the arm is locked in the operational position and the drive is selectively energizable and an unlocked condition wherein the arm is pivotable.

6 Claims, 7 Drawing Sheets

TOY EMBROIDERY MACHINE HAVING ROTATABLE MEANS FOR ACTIVATING A SELECTIVELY ENERGIZABLE DRIVE MECHANISM

FIELD OF INVENTION

This invention relates to a toy embroidery apparatus. In particular, this invention relates to an apparatus for undertaking an embroidery stitch with a minimal risk of injury to an operator.

BACKGROUND OF INVENTION

Toy sewing machines, intended for use by children, are readily available in the marketplace. However, such apparatus must operate in a failsafe manner in which a child could not inadvertently operate the apparatus in a manner which could cause injury to the child or others.

SUMMARY OF THE INVENTION

The disadvantages of the prior art may be overcome by providing a toy embroidery apparatus having a shroud for protecting the penetration of the needle during use and a switch which locks the shroud in place and which controls the energizing of the apparatus for use.

According to one aspect of the invention, there is provided a toy embroidery apparatus having a needle mounted within the housing. An arm is pivotally mounted on the housing for movement between an operational position and a standby position. When the arm is in the operational position, a tubular shroud encloses a tip of the needle as it reciprocates and prevents the arm from pivoting until the tip of the needle is fully retracted within the housing. A drive effects reciprocating movement of a tip of the needle in and out of the housing. A switch selectively energizes the drive. The switch is rotatable between a locked condition wherein the arm is locked in the operational position and the drive is selectively energizable and an unlocked condition wherein the arm is pivotable.

DESCRIPTION OF DRAWINGS

In drawings which illustrate the embodiment of the invention.

DESCRIPTION OF THE INVENTION

Figure 1:
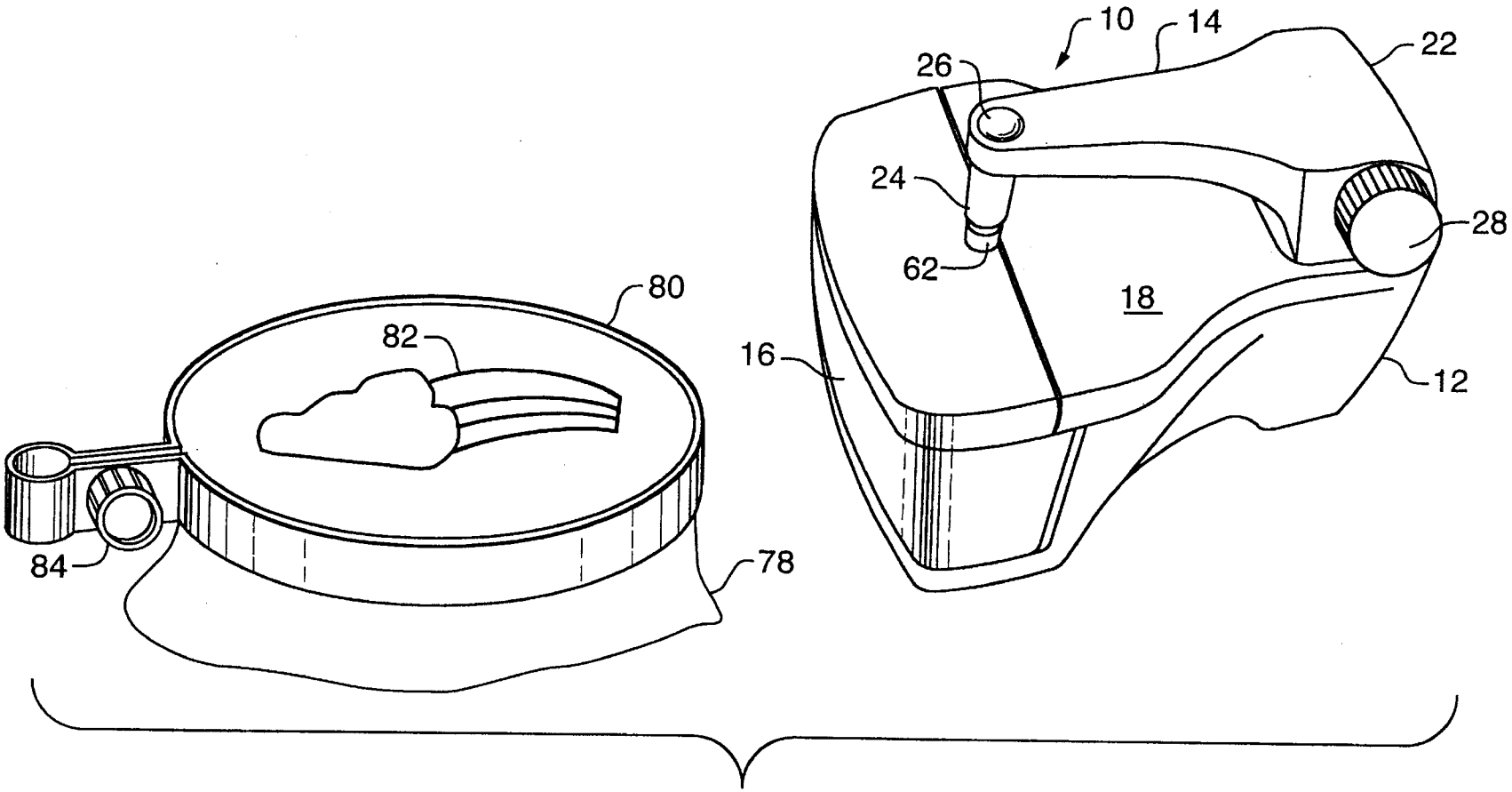
FIG. 1 is a perspective view of the present invention.
Figure 2:
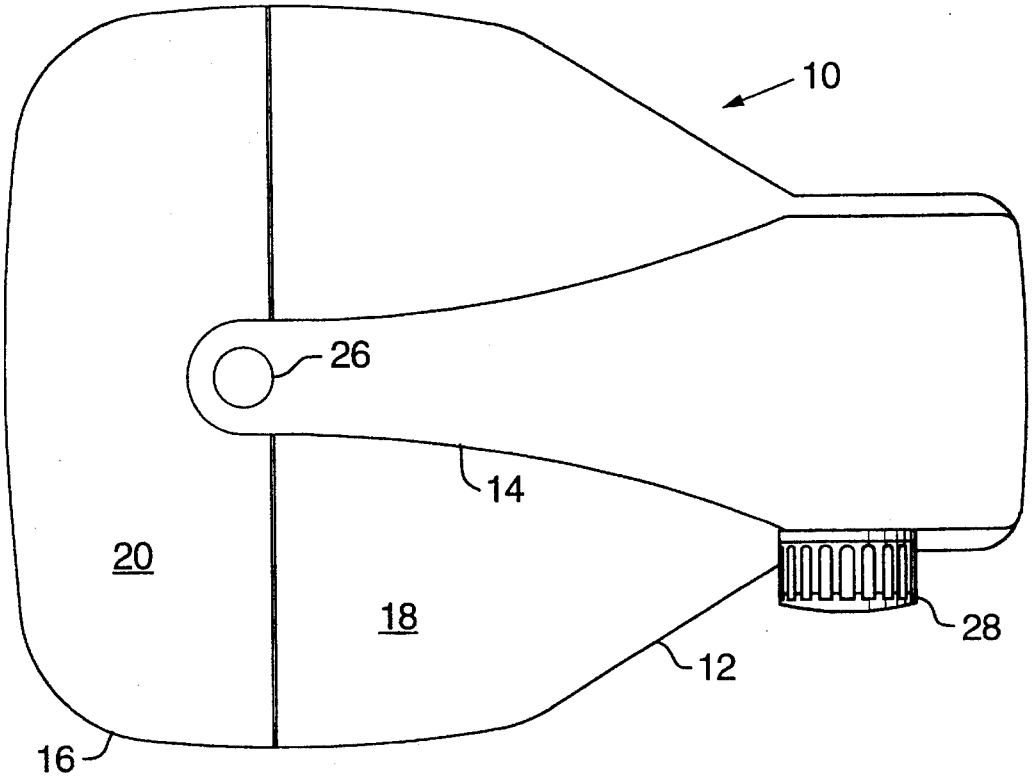
FIG. 2 is a top plan view of the embodiment of FIG. 1.
Figure 3:
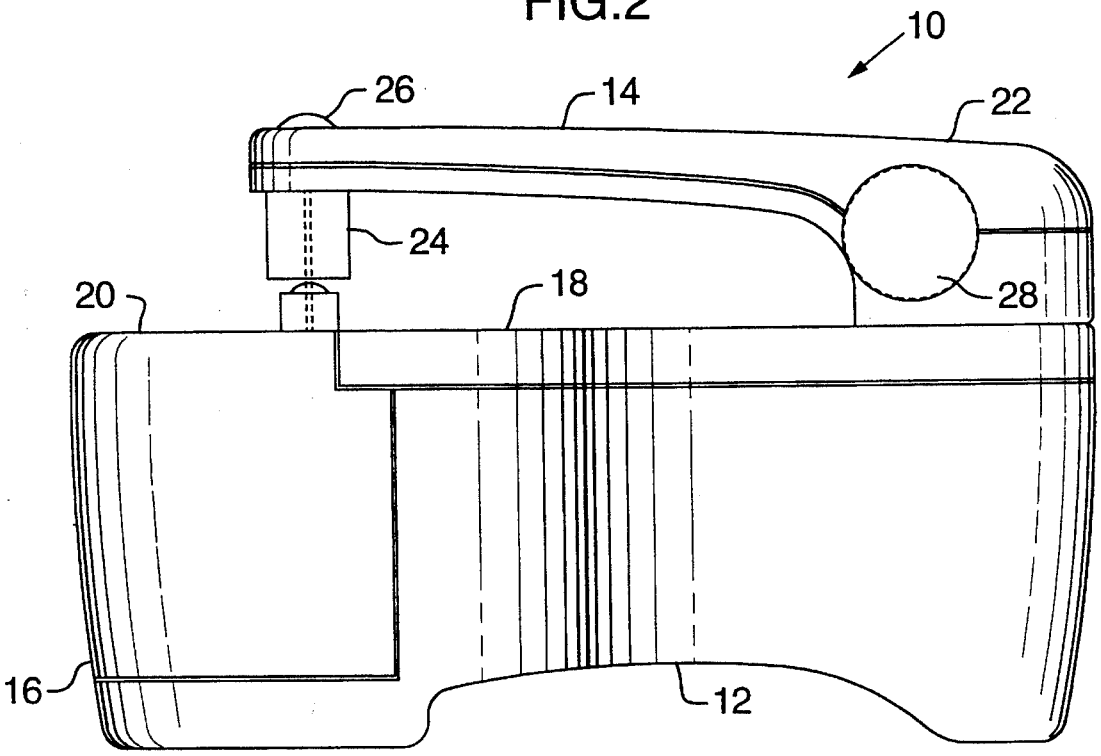
FIG. 3 is a side elevational view of the embodiment of FIG. 1.

Referring to FIGS. 1, 2 and 3, the toy embroidery apparatus 10 of the present invention generally comprises a hollow housing 12, an arm 14 and a cover plate 16. Housing 12 is generally hollow and defines an upper planar surface 18. Cover plate 16 is hingedly mounted at one end of housing 12. Cover plate 16 has an upper planar surface 20. When the cover plate 16 is in a closed condition, surfaces 18, 20 are substantially co-planar defining a sewing platform.

Arm 14 is pivotally mounted to housing 12 at pivoting end 22. Shroud 24 is mounted at the end opposite pivoting end 22. Arm 14 is contoured to extend over planar surface 18 and to space shroud 24 slightly above the junction between co-planar surfaces 18, 20.

Shroud 24 is substantially tubular. Preferably, shroud 24 is made of a transparent or clear plastic material to permit the operator to watch the embroidery needle in operation. Arm 14 is also provided with bubble 26 which is mounted on the upper surface of arm 14 but in vertical alignment with shroud 24. Bubble 26 is preferably made of a clear plastic providing visual access to the operation of the embroidery needle.

At the pivoting end of arm 14, knob 28 operates the locking mechanism of the arm 14 and also energizes the operation of the embroidery needle.

Figure 5:
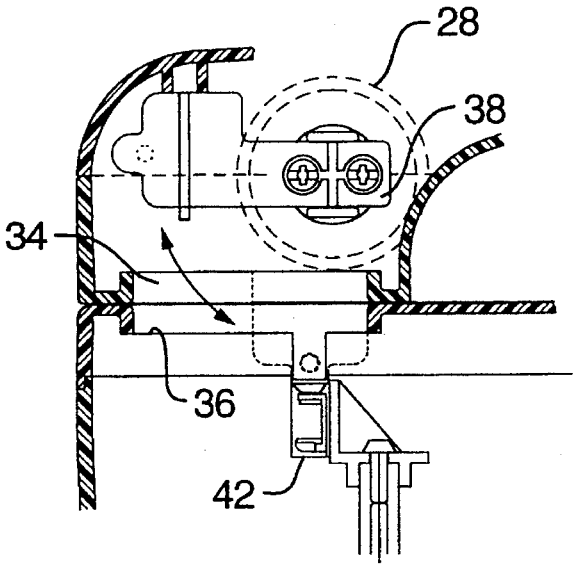
FIG. 5 is sectional view of the switch of the embodiment of FIG. 1.
Figure 4:
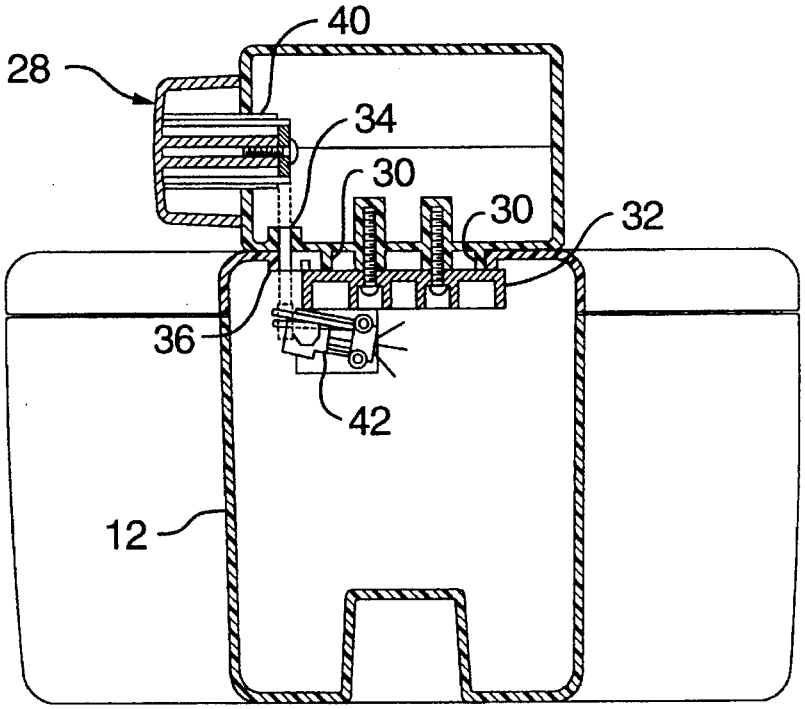
FIG. 4 is an end elevational view, partly in section, of the embodiment of FIG. 1.
Figure 7:
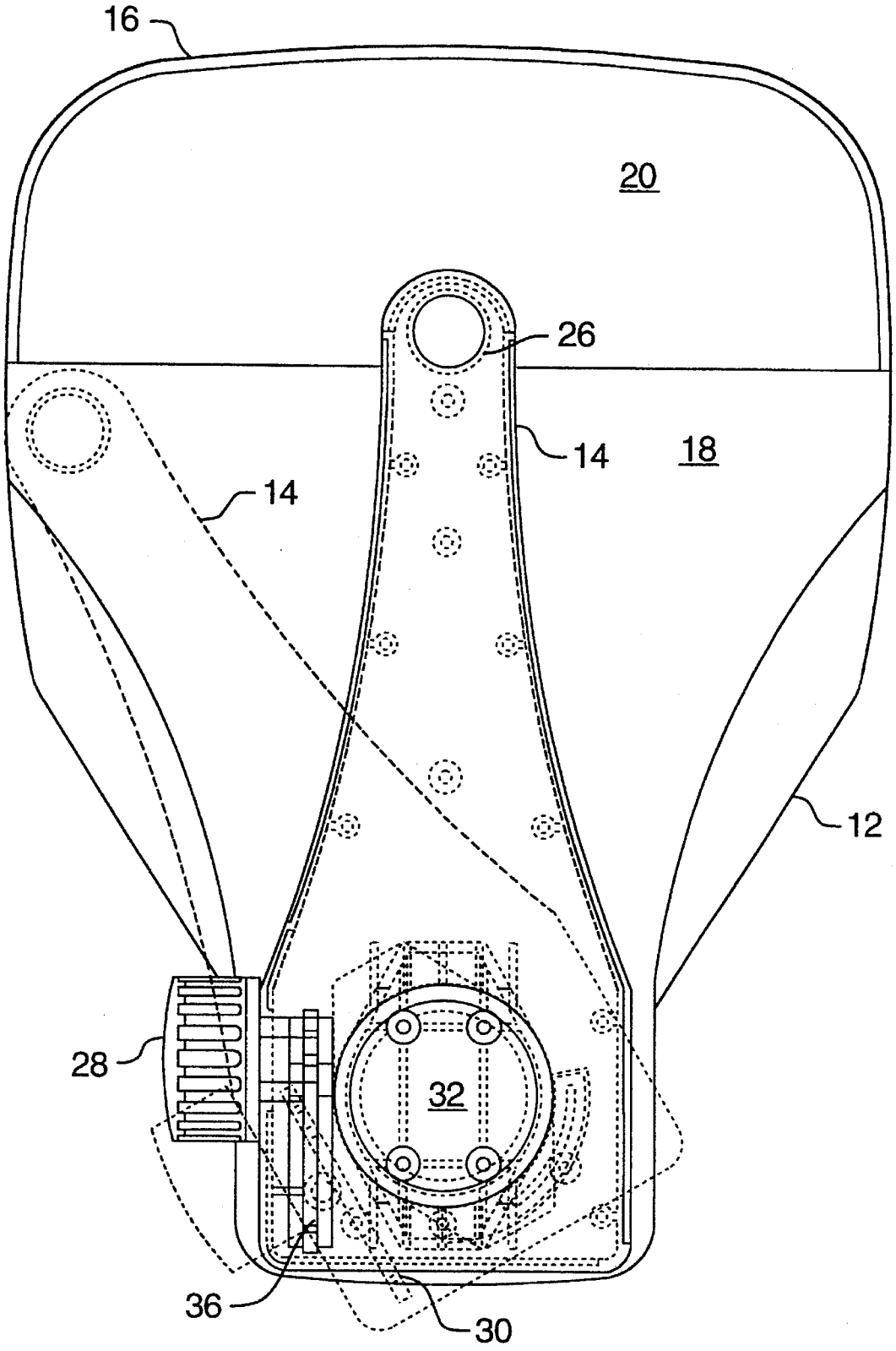
FIG. 7 is a top plan view of embodiment of FIG. 1 illustrating the operational and standby positions.
Figure 8:
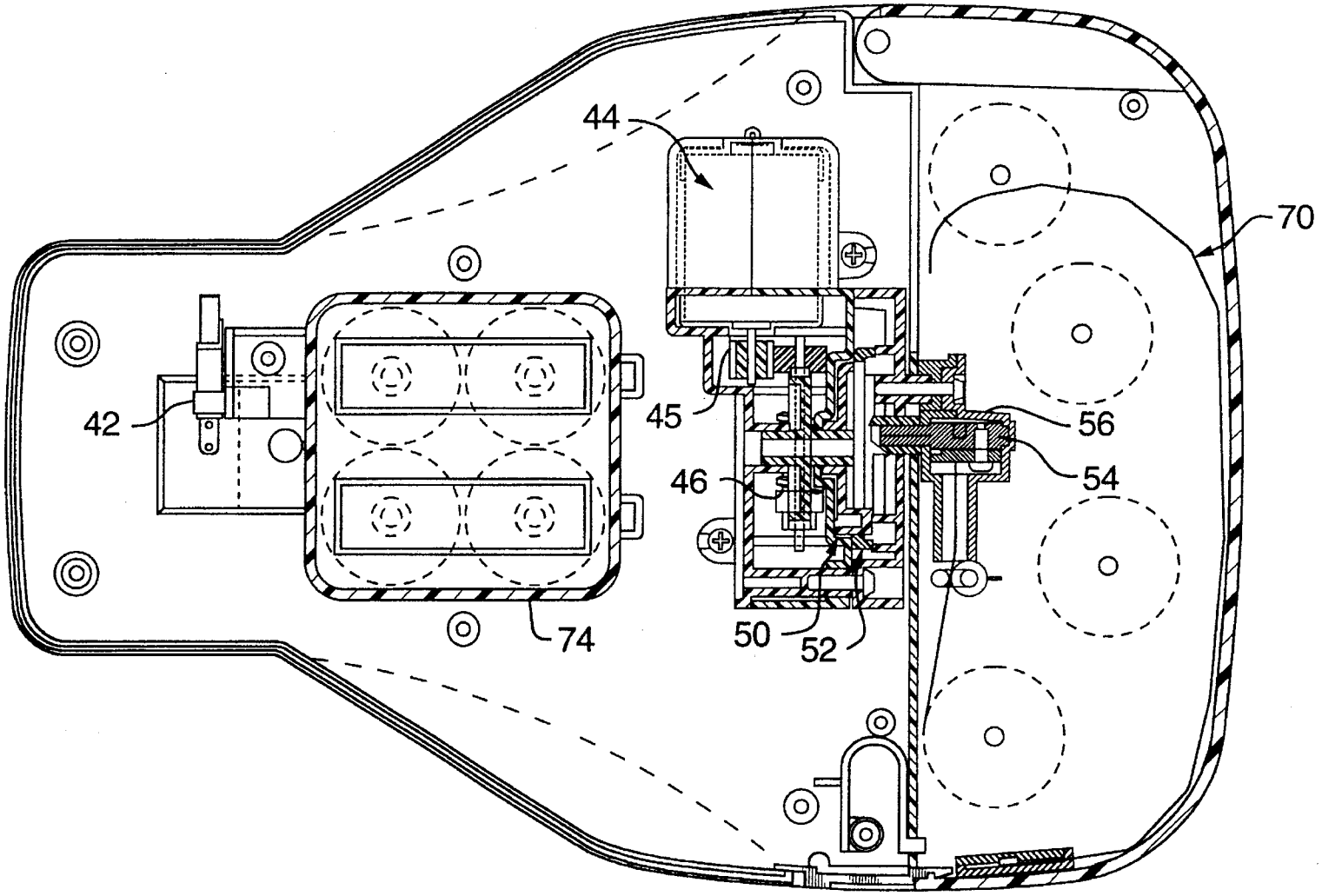
FIG. 8 is a bottom sectional view of the embodiment of FIG. 1.
Figure 9:
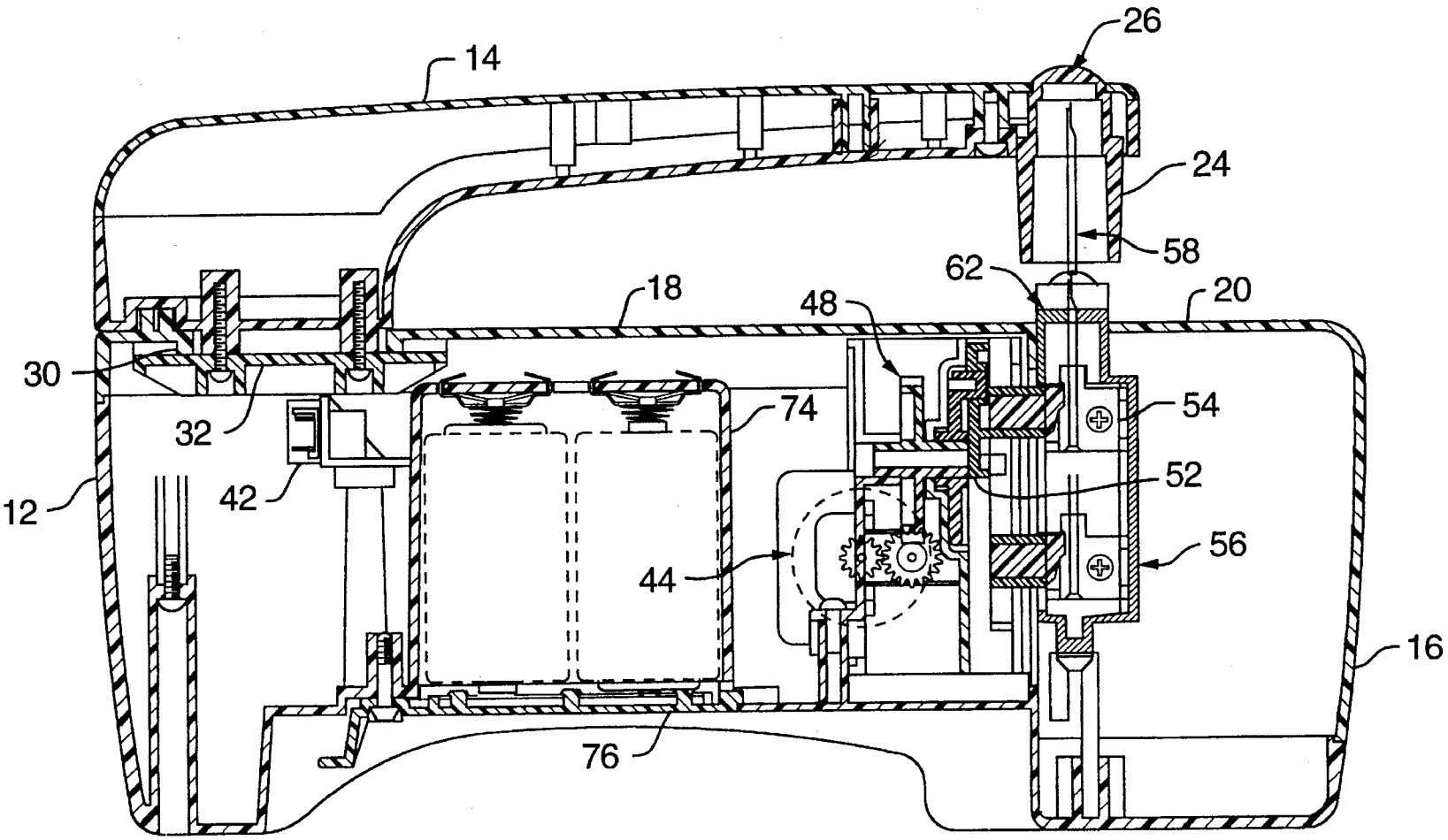
FIG. 9 is a side sectional view of the embodiment of FIG. 1.
Figure 10:
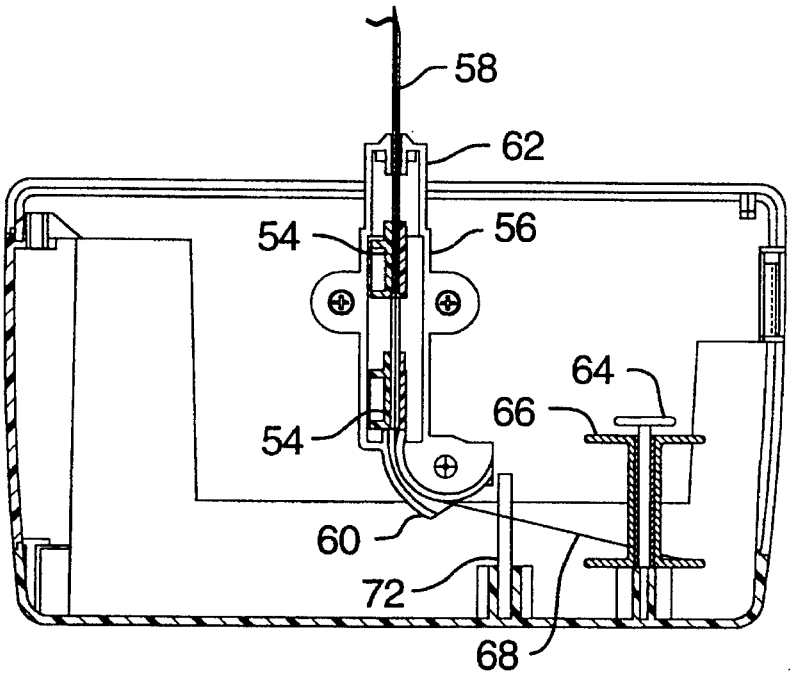
FIG. 10 is a partial section view of an end elevational view of the embodiment of FIG. 1.
Figure 11:
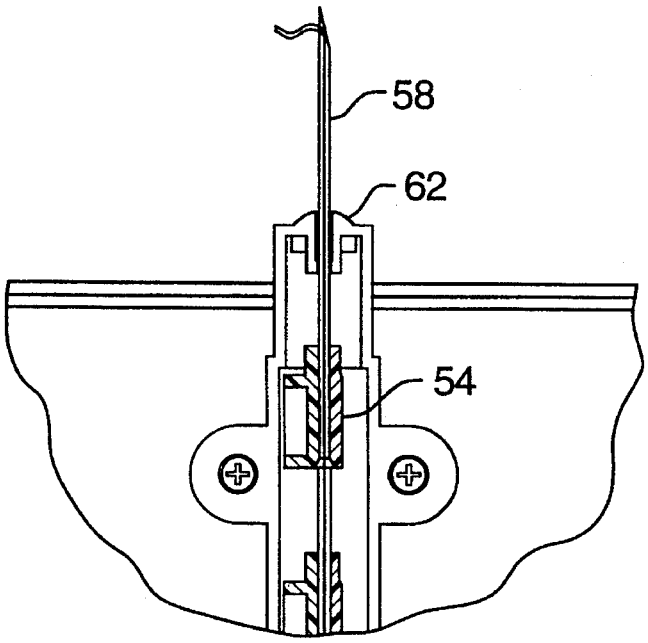
FIG. 11 is a side elevational view of an embroidery needle of the embodiment of FIG. 1.

Referring to FIGS. 4 and 5, arm 14 may be pivotally mounted to housing 12 in any known manner. In the present embodiment, planar surface 18 has a circular aperture adapted to receive a circular flange 30 extending downwardly from the base of arm 14. A retainer plate 32 is fastened from within housing 12 to the base of arm 14.

Extending between the center of rotation of the pivot of arm 14 and the centre of bubble 26 is an imaginary longitudinal axis. Extending substantially parallel to this imaginary axis is slot 34 in the base of arm 14. Planar surface 18 is also provided with a longitudinal slot 36 which will communicate with slot 34 when arm 14 is in an operational position.

Knob 28 is rotatably mounted on the side of arm 14. Inside of arm 14, switch plate 38 is mounted to the stem 40 of knob 28. As is apparent, switch plate 38 will rotate as knob 28 rotates. Switch plate 38 is in substantial alignment with slot 34 such that when knob 28 rotates switch plate 38 will rotate to extend through slot 34 and slot 36 when arm 14 is in an operational condition.

Mounted within housing 12 is switch 42. Switch 42 is positioned such that when switch plate 38 is rotated through slots 34 and 36, it will engage a contact lever of the switch for activating same.

When arm 14 is rotated from the operational position, slots 34 and 36 will no longer align. Accordingly, switch plate 38 is unable to rotate and engage switch 42 for activation of the embroidery needle. Equally, when switch plate 38 is extending through slots 34 and 36, arm 14 is locked in the operational position and is unable to pivot and thereby preventing access to the embroidery needle.

Figure 6:
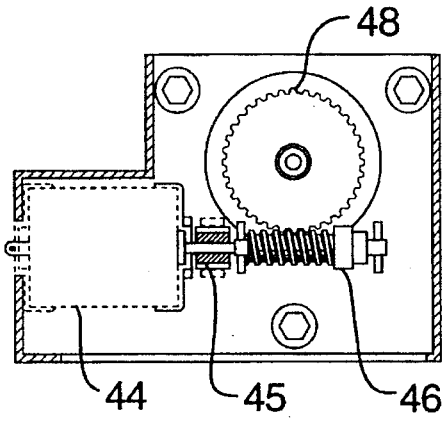
FIG. 6 is an end view of the motor and gear arrangement of the embodiment of FIG. 1.

As illustrated in FIG. 6, motor 44 is mounted internally of housing 12 and has a drive shaft on which a driving gear is mounted. Driving gear engages and drives a driven worm gear 46. Worm gear 46 engages driven gear 48. Cam 50 is mounted on a common axle with driven gear 48. Upon rotation of driven gear 48, cam 50 urges cam plate 52 to move in a reciprocating manner. Such arrangement is well known in the art and described in detail in Canadian Patent No. 344,063.

Referring to FIGS. 8, 9, 10 and 11, needle mount 54 is mounted on cam plate 52 within slide housing 56. Slide housing 56 is adapted to allow needle mount 54 to slide up and down in a reciprocating manner.

Mounted within needle mount 54, is hollow embroidery needle 58. At the base of slide housing 56 is a thread entry slot 60. At the upper end of slide housing 56 is capsule 62 having an aperture through which embroidery needle 58 extends.

Spool holder 64 is mounted within cover 16. A spool 66 having thread 68 wound thereabout, is mounted such that thread 68 may be threaded through thread entry slot 60 upwardly through the hollow needle 58 and exit out the point. A wire having a thread grasping end may be used to facilitate the threading of needle 58. Further, a thread guide 72 may also be used to direct the thread from the spool 66 to the thread entry slot 60.

Housing 12 has a battery compartment 74 for housing batteries required for operation of the apparatus 10. Cover plate 76 closes battery compartment 74 in a manner well known in the art.

Motor 44 is electrically connected with the electrical battery source via switch 42. Closing switch 42 will energize motor 44 driving the various gears.

Needle 58 is mounted on needle mount 54 such that when needle mount 54 is at the lower end of slide housing 56, the tip of the needle is within capsule 62. Capsule 64 has a convex surface. The diameter of the convex surface is approximately the same as the inside diameter of the shroud 24. In the upper limit of stroke of needle mount 54, the tip of needle 58 will extend upwardly into shroud 24.

In use, a piece of cloth 78 is placed about an embroidery hoop 80 as is well known in the art and described in more particular detail in Canadian Patent No. 1,010,077. A pattern 82 can be provided to the cloth 78 mounted on the embroidery hoop 80. Embroidery hoop comprises an outer hoop and an inner hoop. Knob 84 opens and closes the outer hoop about the inner hoop gripping the cloth 78 therebetween.

Arm 14 is rotated from a standby position until shroud 24 covers capsule 62. In this operational position, slots 34 and 36, will be in substantial alignment allowing rotation of knob 28 and switch plate 38 to extend through slots 34, 36 for engagement and activation of contact switch 42.

The switch is activated until needle mount 54 is in the bottom of slide housing 56 or at the bottom stroke of embroidery needle 58. In this position, the tip of the needle 58 is retracted from the shroud 24. Knob 28 is rotated, rotating switch plate 38 out of slots 34 and 36 to an unlocked condition. Arm 14 is free to pivot about its axis to a standby position. Since needle 58 is at the bottom of the stroke, the tip is below capsule 62 allowing free pivoting of arm 14.

The embroidery cloth 78 and hoop 80 can be placed over the capsule 62 with the embroidery hoop resting upon surface 18, 20. Arm 14 is rotated back into the operation position. Shroud 24 is spaced from the outer perimeter of capsule 62 a distance which permits the cloth to extend over the convex surface thereof but will not permit an operator's fingers to be inserted into the path of the tip of the reciprocating embroidery needle 58. Knob 28 can be rotated, rotating switch plate 38 for activation of motor 44 which will cause reciprocal motion of embroidery needle 58.

The operator uses one hand to manipulate knob 28 while manipulating the embroidery hoop to position the cloth at the desired location for penetration by embroidery needle 58. In this manner, an embroidery stitch is facilitated by the apparatus 10.

To remove the cloth and embroidery hoop, the apparatus 10 is moved into its unlocked condition allowing arm 14 to be pivoted away from capsule 62 to its standby position, allowing removal of the cloth and the embroidery hoop.

Since the embroidery stitch is a non-interlocking stitch, the loop portions of the stitch may glued to the cloth for permanent attachment thereto.

The apparatus 10 of the present invention has two locking systems for preventing unsafe usage of the apparatus. First, the motor 44 cannot be energized unless the arm 14 is in the operational position with the shroud 24 substantially enclosing the tip of the embroidery needle 58 as it reciprocates. Second, the arm 14 cannot be pivoted from the operational position to the standby position unless the tip of the embroidery needle 58 is fully retracted within the housing 12. Both of these systems operate to substantially minimize the risk of accidental injury to the operator of the apparatus 10.

Although the disclosure describes and illustates the preferred embodiment of the invention, it is understood that the invention is not limited to this particular embodiment. Many variations and modifications will now occur to those skilled in the art. For definition of the invention, reference is made to the appended claims.

In particular, the knob 28 and switch plate 38 could be mounted within housing 12 and still achieve the dual function of locking the arm 14 in the operational position and energizing the motor 44.

I claim:

1. A toy embroidery apparatus comprising a housing, a needle mounted within the housing, an arm pivotally mounted on said housing between an operational position and a standby position, said arm having a tubular shroud for substantially enclosing said tip of the needle when said arm is in the operational position and preventing said arm from pivoting until said tip of the needle is fully retracted within said housing, a drive means for effecting reciprocating movement of a tip of the needle in and out of the housing, a switch means for selectively energizing said drive means, said switch means being rotatable between a locked condition wherein said arm is locked in the operational position and said drive means is selectively energizable and an unlocked condition wherein said arm is pivotable between said operational position and said standby position.

2. A toy embroidery apparatus as claimed in claim 1 wherein when said arm is in said operational position, said shroud is spaced from said housing to permit a cloth to be embroidered to be inserted therebetween.

3. A toy embroidery apparatus as claimed in claim 2 wherein said arm is contoured to extend over a sewing platform of said housing.

4. A toy embroidery apparatus as claimed in claim 1 wherein said switch means comprises a rotatably mounted switch plate, a first slot in said arm and a second slot in said housing, said switch plate is rotatable to engage a contact switch when said first and second slots are in substantial alignment with each other.

5. A toy embroidery apparatus as claimed in claim 4 wherein said switch plate is rotatably mounted within the arm.

6. A toy embroidery apparatus as claimed in claim 1 wherein said shroud is made of a transparent plastic material.

* * * * *

UNITED STATES PATENT AND TRADEMARK OFFICE

CERTIFICATE OF CORRECTION

PATENT NO. : 5,520,128

DATED : May 28, 1996

INVENTOR(S) : Hugh Rich and Judy Shackelford

It is certified that error appears in the above-identified patent and that said Letters Patent is hereby corrected as shown below:

| | |
|---|---|
| In the Abstract, Line 1 | After "mounted" delete -- movement reciprocally --. |

Signed and Sealed this

Twenty-first Day of April, 1998

Bruce Lehman

*Attest:*

BRUCE LEHMAN

*Attesting Officer*

*Commissioner of Patents and Trademarks*